US006789360B2

(12) United States Patent
Silberman et al.

(10) Patent No.: US 6,789,360 B2
(45) Date of Patent: Sep. 14, 2004

(54) RETRACTABLE ROOF SYSTEM FOR STADIUM

(75) Inventors: Cyril Silberman, Minnetonka, MN (US); David Sadinsky, Minneapolis, MN (US); Bart Riberich, Brooklyn Park, MN (US); Andrew Cheng, New Brighton, MN (US); Lennart Nielson, Edina, MN (US); Terry Thompson, Minneapolis, MN (US); Timothy J. Kline, Minnetonka, MN (US)

(73) Assignee: Uni-Systems, LLC, Minneapolis, MN (US)

( * ) Notice: Subject to any disclaimer, the term of this patent is extended or adjusted under 35 U.S.C. 154(b) by 37 days.

(21) Appl. No.: 10/053,790

(22) Filed: Jan. 22, 2002

(65) Prior Publication Data

US 2002/0129565 A1 Sep. 19, 2002

Related U.S. Application Data

(60) Provisional application No. 60/263,645, filed on Jan. 23, 2001.

(51) Int. Cl.[7] ..... E04H 3/10
(52) U.S. Cl. ..... 52/66; 52/6
(58) Field of Search ..... 52/6, 66, 68, 64

(56) References Cited

U.S. PATENT DOCUMENTS

| | | | | |
|---|---|---|---|---|
| 2,052,217 A | | 8/1936 | Sibour et al. | |
| 2,126,413 A | * | 8/1938 | Respess | 52/83 |
| 2,603,171 A | | 7/1952 | Smith | |
| 2,642,162 A | | 6/1953 | Tobias | |
| 3,009,211 A | | 11/1961 | Hansen et al. | |
| 3,213,571 A | | 10/1965 | Olson | |
| 3,288,158 A | | 11/1966 | Gugliotta | |

FOREIGN PATENT DOCUMENTS

| | | |
|---|---|---|
| JP | 2-217539 A | 8/1990 |
| JP | 2-269237 A | 11/1990 |
| JP | 3-87434 A | 4/1991 |
| JP | 3-115632 A | 5/1991 |
| JP | 4-323446 A | 11/1992 |
| NL | 8006712 | 7/1982 |

(List continued on next page.)

*Primary Examiner*—Carl D. Friedman
*Assistant Examiner*—Basil Katcheves
(74) *Attorney, Agent, or Firm*—Knoble Yoshida & Dunleavy, LLC

(57) ABSTRACT

A convertible stadium includes an exhibition area, a seating area and a plurality of roof support locations for supporting a movable or retractable roof assembly. The roof assembly includes a first major truss that spans a distance between a first and a second of the roof support locations and a second major truss that spans a distance between a third and a fourth of the roof support locations. Both of the first and second major trusses are preferably structurally configured as a tied arch, each of which has a generally convex upper portion and a lower portion that is adapted to assume gravity induced stresses within the trusses as tension. In order to keep the center of mass of the major trusses generally positioned within a plane including the roof support locations, which optimizes lateral stability of the major trusses, the major trusses are most preferably given a lenticular shape, meaning that the lower portion of the trusses is convex and in fact preferably generally symmetrical to the upper portion. First and second convex guide tracks are respectively mounted to the upper portions of the first and second major trusses, and a movable roof member is mounted for movement along the guide tracks. Advantageously, the guide wheels and the drive wheels on the movable roof member engage the upwardly facing and downwardly facing surfaces on the guide tracks, and are biased together so as to provide sufficient traction to be able to move the movable roof member along the guide tracks even when such movement has an upward component due to the convex shape of the guide tracks.

23 Claims, 13 Drawing Sheets

U.S. PATENT DOCUMENTS 3,534,511 A 10/1970 Cappella
3,608,252 A 9/1971 Bisson
3,766,691 A 10/1973 Ray
4,175,361 A 11/1979 Kumode
4,257,199 A 3/1981 Kuboyama
4,348,833 A 9/1982 Nagoya
4,587,775 A 5/1986 Lewis et al.
4,616,451 A 10/1986 Glick
4,676,033 A 6/1987 Allen et al.
4,682,449 A * 7/1987 Berger ..... 52/66
4,706,419 A 11/1987 Adachi et al.
4,716,691 A 1/1988 Allen et al.
4,727,688 A 3/1988 Kida et al.
4,738,057 A 4/1988 Logan
4,751,800 A 6/1988 Kida et al.
4,802,314 A 2/1989 Schildge, Jr.
4,831,792 A 5/1989 Berger
4,833,837 A 5/1989 Bonneau
4,920,707 A 5/1990 Moskaliuk et al.
4,936,060 A 6/1990 Gelinas et al.
4,942,698 A 7/1990 Kumagai
4,995,203 A 2/1991 Brisbin et al.
5,007,214 A 4/1991 Itami et al.
5,010,695 A 4/1991 Schildge, Jr.
5,027,565 A 7/1991 Sugizaki
5,035,093 A 7/1991 Parazader et al.
5,058,332 A 10/1991 Masuyama et al.
5,062,243 A 11/1991 Kumagai
5,063,730 A 11/1991 Muramoto et al.
5,103,600 A 4/1992 Geiger et al.
5,117,594 A 6/1992 Muramoto et al.
5,167,097 A * 12/1992 Robbie et al. ..... 52/6
5,187,894 A 2/1993 Ripley, Sr. et al.
5,189,851 A * 3/1993 Omika et al. ..... 52/66
5,203,125 A 4/1993 Sugizaki
5,257,481 A 11/1993 Reppas et al.
5,257,485 A 11/1993 Kawaguchi et al.
5,351,449 A * 10/1994 Allen et al. ..... 52/6
5,371,983 A 12/1994 Kawaguchi et al.
5,394,660 A 3/1995 Haris
5,653,066 A 8/1997 Schildge, Jr.
5,682,711 A 11/1997 Warczak
5,746,028 A 5/1998 DiBenedetto
5,778,603 A 7/1998 Reppas
5,896,708 A 4/1999 Doi et al.
5,927,022 A 7/1999 Hirakawa et al.
5,983,575 A * 11/1999 Reppas ..... 52/66
6,082,054 A * 7/2000 Silberman et al. ..... 52/66

* cited by examiner

RETRACTABLE ROOF SYSTEM FOR STADIUM

This application claims priority under 35 USC §119(e) based on U.S. Provisional Application Ser. No. 60/263,645, filed Jan. 23, 2001, the entire disclosure of which is hereby incorporated by reference as if set forth fully herein.

BACKGROUND OF THE INVENTION

1. Field of the Invention

This invention pertains, in general, to the field of retractable covers or roofs for large structures, such as athletic stadiums. More specifically, the invention relates to an improved roof assembly that is lighter in weight, less bulky and less likely to obstruct the vision of spectators within the stadium than comparable mechanisms heretofore known.

2. Description of the Related Technology

It is common in today's environment for athletic stadiums to be constructed with retractable roofs, because this type of construction offers spectators the pleasure of being outdoors on nice days, while providing shelter when necessary against extreme temperatures and inclement weather conditions. A retractable roof also makes possible the growth of natural grass within the stadium, which is increasingly felt to be desirable in professional and major collegiate athletics.

A number of factors must be taken into account in the design of a stadium that has a retractable roof. For instance, the forces created by the exertion of natural forces such as wind, rain snow and even earthquakes on such a large structure can be enormous, and the roof, the underlying stadium structure and the transport mechanism that is used to guide and move the roof between its retracted and operational positions must be engineered to withstand the worst possible confluence of such forces. In addition, for reasons that are both aesthetic and practical, it is desirable to make the structural elements of the roof and the transport mechanism to be as unobtrusive and as space-efficient as possible. It is also desirable to make the roof structure and the transport mechanism as lightweight as possible, both to minimize the amount of energy that is necessary to open and close the roof structure and to minimize the need for additional structural reinforcement in the roof structure and in the underlying stadium structure. Most conventional stadium roof designs utilize a plurality of structural trusses, each of which spans a distance between a first location on one side of the stadium and a second location on an opposite side of the stadium. A truss is a simple skeletal structure of individual structural members that, according to static analysis theory, will only be subject to tension and compression forces and not bending forces. The most simple type of truss, known as the Warren truss, includes parallel upper and lower horizontal elements and a plurality of diagonal elements connecting the upper and lower horizontal elements. When a bending stress is applied to the truss, the diagonal elements will assume the stress, either as tension or compression, depending upon the orientation of the diagonal element. A structural truss that must span the type of distance that is typical in a stadium, however, typically requires vertical structural elements as well as diagonal elements to provide additional strength.

For a number of reasons, it is considered undesirable to elevate the roof structure any great distance above the main structural mass of the stadium. Unfortunately, since the seating area of the stadiums extends to the very top of the stadium, in many stadiums the structural trusses of the roof interfere with the view from some seats.

A need exists for an improved stadium roof design that will be lighter in weight, less bulky and less likely to interfere with the view of spectators within the stadium than the conventional stadium roof designs discussed above.

SUMMARY OF THE INVENTION

Accordingly it is an object of the invention to provide an improved stadium roof design that will be lighter in weight, less bulky and less likely to interfere with the view of spectators within the stadium than the conventional stadium roof designs discussed above.

In order to achieve the above and other objects of the invention, a roof assembly for a stadium that is constructed according to a first aspect of the invention includes at least one major truss spanning a distance between a first support location and a second support location that is at least 200 feet, the major truss being structurally configured as a tied arch having a curved convex upper portion and a lower portion that is shaped, sized and positioned to assume most gravity induced stress within the major truss as tension; and at least one roof member that is secured to said the truss.

According to a second aspect of the invention, a convertible stadium assembly includes a stadium having an exhibition area, a seating area and a plurality of roof support locations, a first major truss spanning a distance between a first of the roof support locations and a second of the roof support locations that is at least 200 feet, the first major truss being structurally configured as a tied arch; a second major truss spanning a distance between a third of the roof support locations and a fourth of the roof support locations that is also at least 200 feet, the second major truss also being structurally configured as a tied arch, a first guide track mounted to the first major truss, a second guide track mounted to the second major truss, a movable roof member that is mounted for movement along the first guide track at a first location and that is further mounted for movement along the second guide track at a second location, a drive system for moving the movable roof member along the first and second guide tracks; and a control system for controlling the drive system.

A convertible stadium assembly that is constructed according to a third embodiment of the invention includes a stadium having an exhibition area, a seating area and a plurality of roof support locations; a first support structure spanning a distance between a first of the roof support locations and a second of the roof support locations that is at least 200 feet; a second support structure spanning a distance between a third of the roof support locations and a fourth of the roof support locations that is also at least 200 feet; a first guide track mounted to the first support structure, the first guide track being shaped so as to be continuously convexly upwardly curved; a second guide track mounted to the second support structure, the second guide track being shaped so as to be continuously convexly upwardly curved; a movable roof member that is mounted for movement along the first guide track at a first location and that is further mounted for movement along the second guide track at a second location; a drive system for moving the movable roof member along the first and second guide tracks; and a control system for controlling the drive system.

These and various other advantages and features of novelty that characterize the invention are pointed out with particularity in the claims annexed hereto and forming a part hereof. However, for a better understanding of the invention, its advantages, and the objects obtained by its use, reference should be made to the drawings which form a further part hereof, and to the accompanying descriptive matter, in which there is illustrated and described a preferred embodiment of the invention.

DETAILED DESCRIPTION OF THE PREFERRED EMBODIMENT(S)

Figure 1:
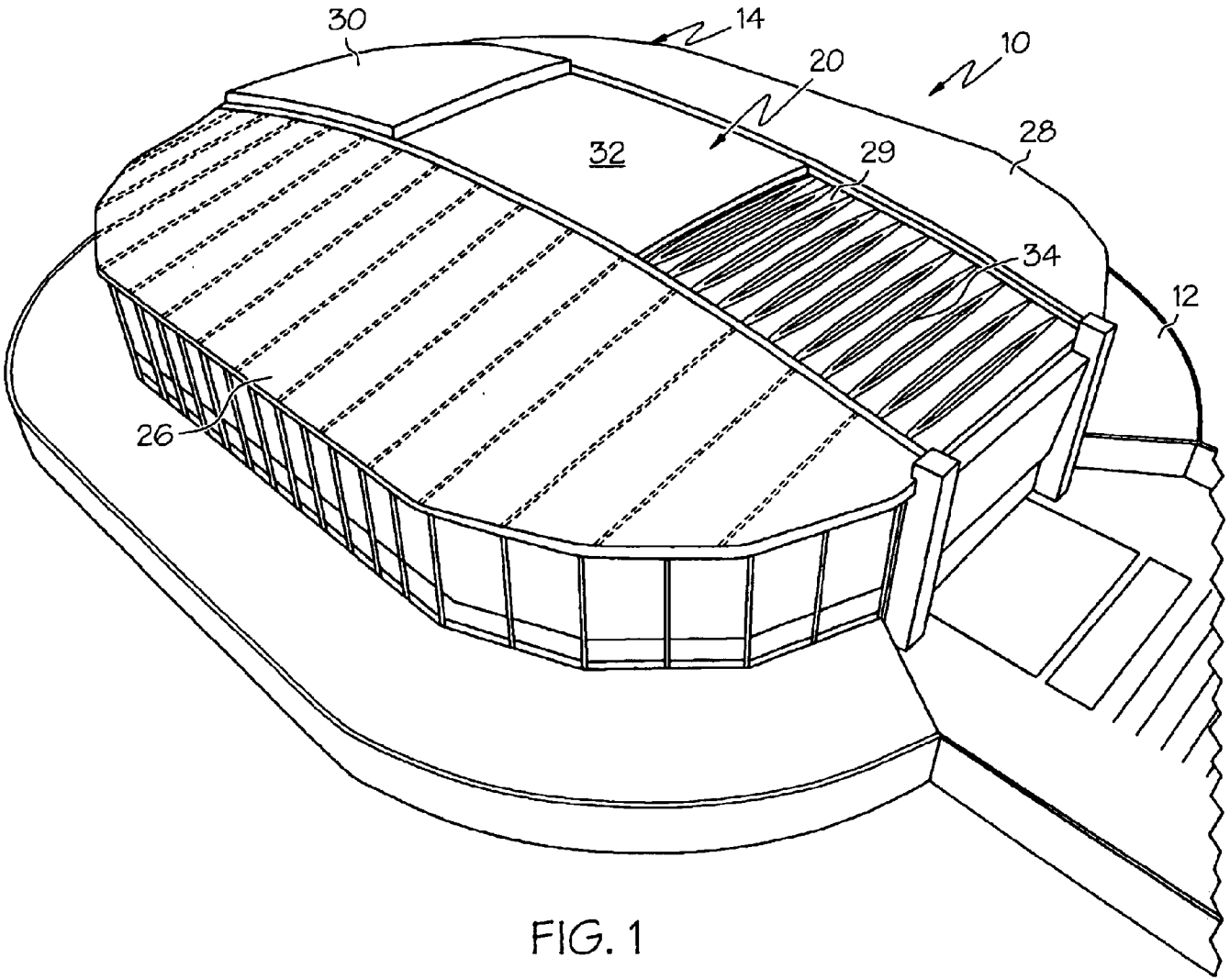
FIG. 1 is a perspective view of a convertible stadium facility that is constructed according to a preferred embodiment of the invention.
Figure 3:
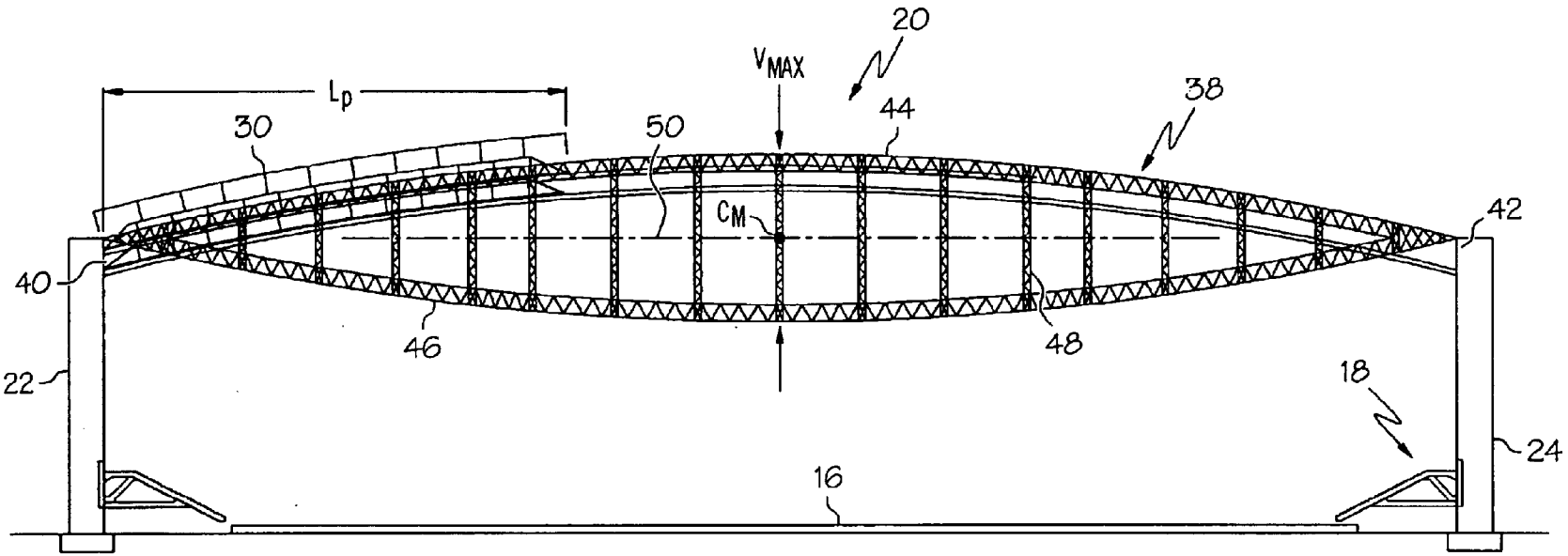
FIG. 3 is a diagrammatical cross-sectional view depicting a major truss that is used in the stadium that is depicted in FIGS. 1 and 2.
Figure 4:
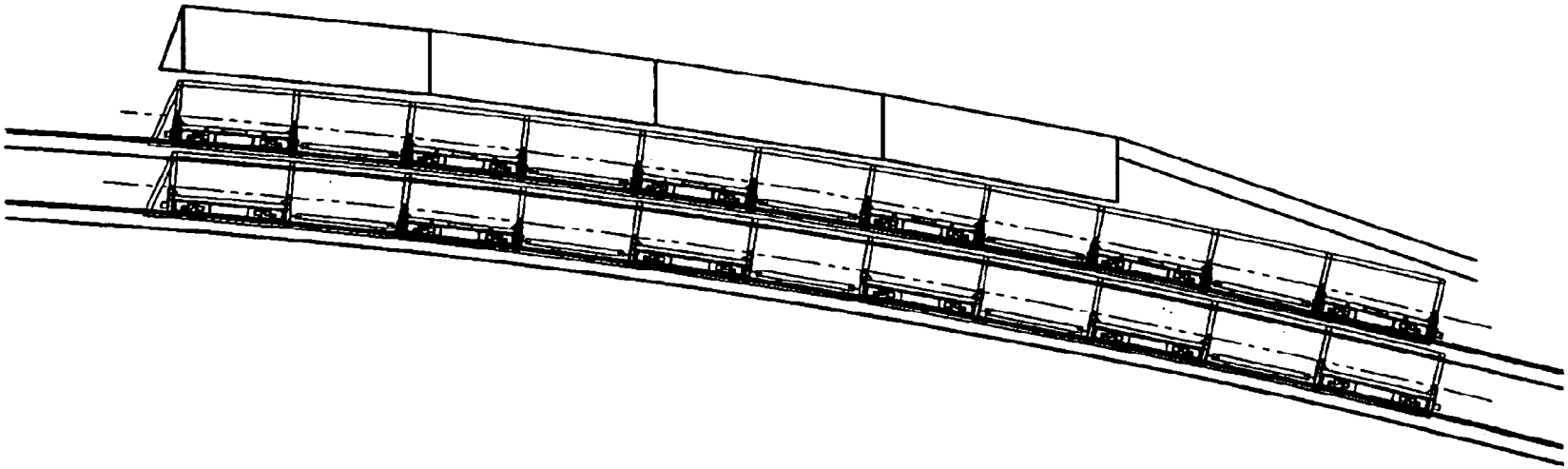
FIG. 4 is a fragmentary cross-sectional view depicting the roof portion of the stadium facility in a first operational position.

Referring now to the drawings, wherein like reference numerals designate corresponding structure throughout the views, and referring in particular to FIG. 1, a convertible stadium assembly 10 that is constructed according to the preferred embodiment of the invention includes an outdoor area 12 and a stadium 14 having, as may be seen in FIG. 3, a central exhibition area 16 that may be configured as a playing field or the like and a seating area 18 surrounding the central exhibition area 16. Stadium 14 is provided with a retractable roof assembly 20 that in the preferred embodiment includes a first fixed roof area 26 covering a first portion of the seating area 18 and a second fixed roof area 28 that may covering a second portion of the seating area 18. Retractable roof assembly 20 further includes a central area 29 between the first and second fixed roof areas 26, 28 in which are positioned a fixed roof panel 30, an upper movable roof panel 32 and a lower movable roof panel 34, as shown in FIG. 1. In the preferred embodiment, the central area 29 is positioned substantially over the central exhibition area 16. As will be explained in greater detail below, the upper and lower movable roof panels 32, 34 are movable into an extended position wherein the entire central area 29 is covered, so that the entire interior of the stadium 14 is isolated from the outside environment. Alternatively, one or both of the movable roof panels 32, 34 may be moved so as to overlap with each other and/or the fixed roof panel 30 so as to open the roof of the stadium 14 to a desired extent. In the full open position, substantially all of the upper movable roof panel 32 will be positioned beneath the fixed roof panel 30, and the lower movable roof panel 34 will be substantially positioned beneath the upper movable roof panel 32, as is shown in FIG. 4. In this position, about two-thirds of the center area 29 of the roof assembly 20 will be uncovered and open to the environment. In this position, an athletic event may be conducted in a semi outdoor environment, or sunlight may be allowed into the stadium 14 to permit the growth of natural grass.

Figure 2:
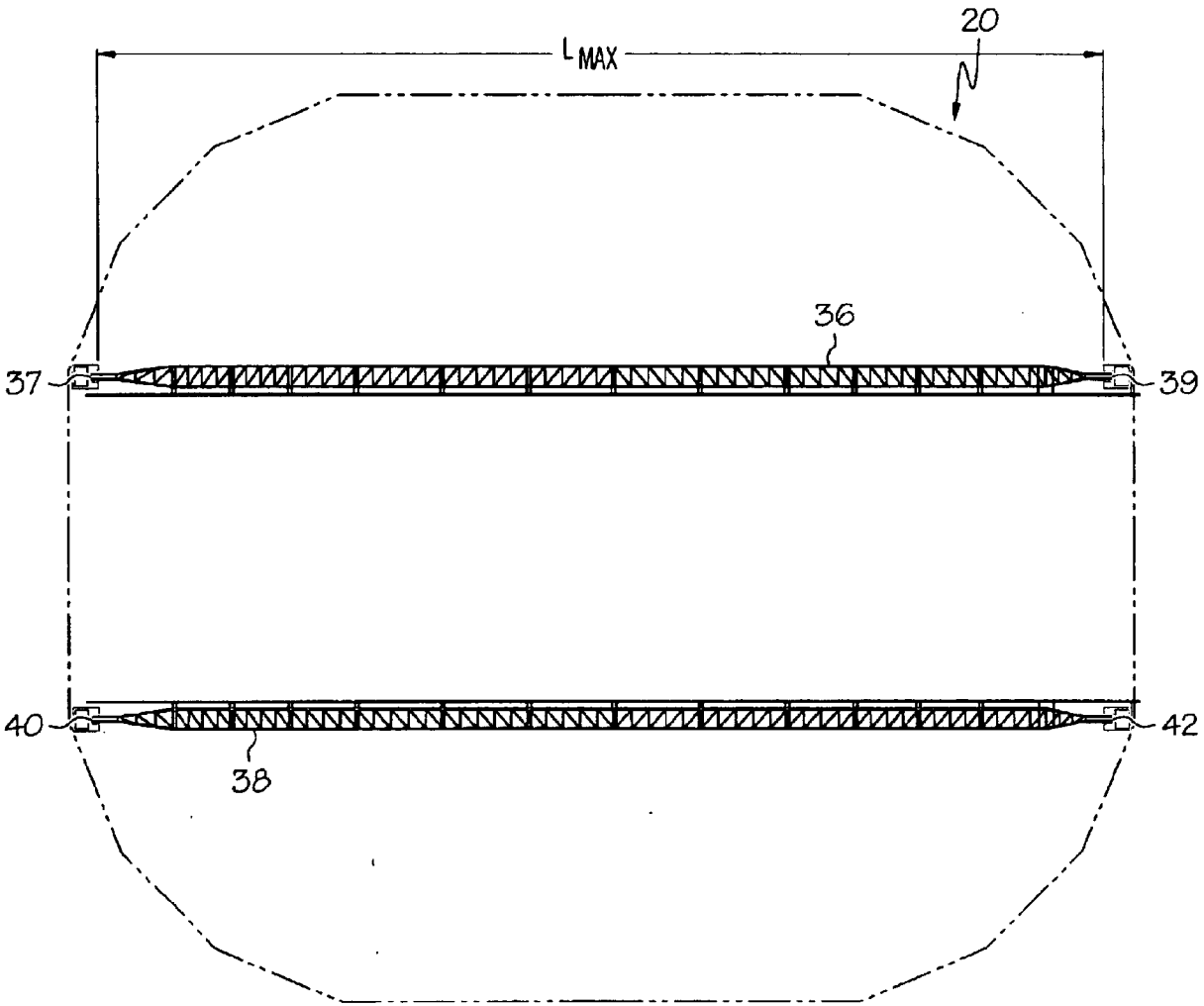
FIG. 2 is a plan view of a roof portion of the stadium facility that is depicted in FIG. 1.

Referring now to FIGS. 2 and 3, it will be seen that the retractable roof assembly 20 includes a first major truss 36 that spans the entire length $L_{max}$ of the stadium 14 along a span axis that is parallel and immediately adjacent to the first fixed roof area 26. A second major truss 38 similarly spans the entire length of the stadium 14 along a span axis (identified by reference numeral 50 in FIG. 3) that is parallel and immediately adjacent to the second fixed roof area 28. The first major truss 36 is supported at its two opposite ends respectively at a first support location 37 and a second support location 39. As is best shown in FIG. 3, the second major truss 38 is likewise supported at its opposite ends at a third support location 40 that is located at a support column 22 and at a fourth support location 42 that is located at a support column 24. In the preferred embodiment, the distance $L_{max}$ that is spanned by the major trusses 36, 38 is at least 200 feet, and is more preferably at least 500 feet. In the preferred embodiment of the invention, the distance $L_{max}$ is about 800 feet. According to one particularly advantageous feature of the invention, each of the major trusses 36, 38 are structurally configured as a tied arch having a curved convex upper portion and a lower portion that is shaped, sized and positioned to assume most gravity induced stress within the major truss as tension. This permits elimination of most or all diagonal structural elements within the major trusses, which has two advantages. First, in the event that a spectator it is forced to look through a portion of one of the major trusses, disability will not be unnecessarily impaired by the presence of a large number of diagonal structural elements. Second, and more importantly, the tied arch configuration permits the major trusses to be substantially lighter in weight than would be required with conventional trusses. In the preferred embodiment of the invention, each of the major trusses is constructed and arranged to have a center of mass CM that is positioned substantially along the span axis 50 that intersects both of the support locations 40,42 for that truss. In addition, each major truss is shaped so as to be substantially symmetrical about said span axis. This is achieved in the preferred embodiment by constructing each major truss so as to be generally lenticular in shape.

As may be seen in FIG. 3, each major truss has an upper chord 44 that is convexly curved, preferably in a continuous, unbroken radius from one end of the major truss to its opposite end. A lower, downwardly convex lower chord 46 is generally symmetrical in shape and in construction to the upper chord 44. A plurality of vertical structural members 48 are each connected at one end to the upper chord 44 and at a second end to the lower chord 46, using known structural construction techniques. As is shown in FIG. 3, each major truss has a maximum vertical dimension $V_{max}$. Preferably, each of the major trusses are proportioned so that $V_{max}$ as a percentage of $L_{max}$ is within a range of about 4 percent to about 20 percent, and more preferably within a range of about 5 percent to about 15 percent. Most preferably, this percentage is within a range of about 10 percent to about 12.5 percent.

Figure 5:
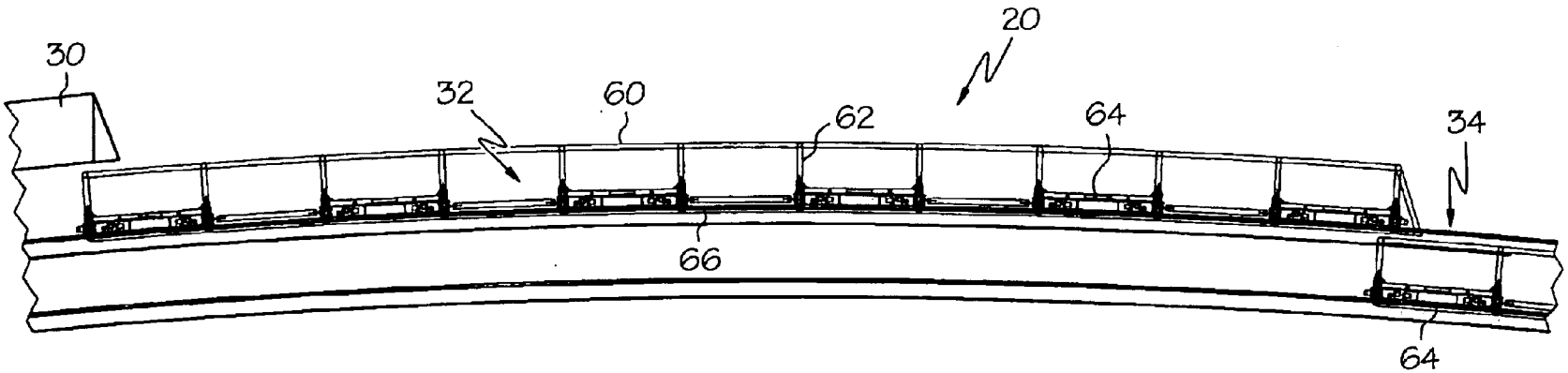
FIG. 5 is a fragmentary cross-sectional view depicting the roof portion of the stadium facility in a second operational position.

Referring now to FIG. 4, it will be seen that both of the major trusses 36, 38 have guide tracks mounted thereto, each of which permits movement of one end of each of the movable roof panels 32, 34. Specifically, the first major truss 36 is configured to support a first, lower guide rail 52 over which one end of the lower roof panel 34 is constructed and arranged to move, and a second, upper guide rail 54 over which one end of the upper roof panel 32 is similarly constructed and arranged to move. The structure mounting the rails 52, 54 to the major truss 36 is best shown in and will be discussed below in relation to FIGS. 10 and 11. As may be seen in FIG. 4, each of the guide rails 52, 54 is secured to the curved, convex portion of the major truss 36 by mounting structure 78 and is itself constructed so as to be upwardly convex and continuously radiused. The lower roof panel 34 includes a roof membrane 56, which is preferably constructed of a waterproof weather resistant fabric and is secured to each of a plurality of carrier assemblies 64 by a number of support elements 58. Similarly, the upper roof panel 32 includes a roof membrane 60 that is supported with respect to a number of carrier assemblies 64 by means of a plurality of support members 62. A plurality of such carrier assemblies 64 are constructed and arranged to traverse each of the rails 52, 54 in order to support one end of the respective movable roof panels 34, 32. Flexible linkages 66 interconnect adjacent carrier assemblies 64 that are positioned on a common rail 52 or 54. FIG. 4 depicts the retractable roof assembly 20 in the fully opened position, wherein both of the movable roof panels 32, 34 are positioned beneath the fixed roof panel 30. FIG. 5, which is otherwise identical to FIG. 4, depicts the roof assembly 20 in the fully closed position, wherein each of the movable roof panels 32, 34 are fully extended.

Figure 6:
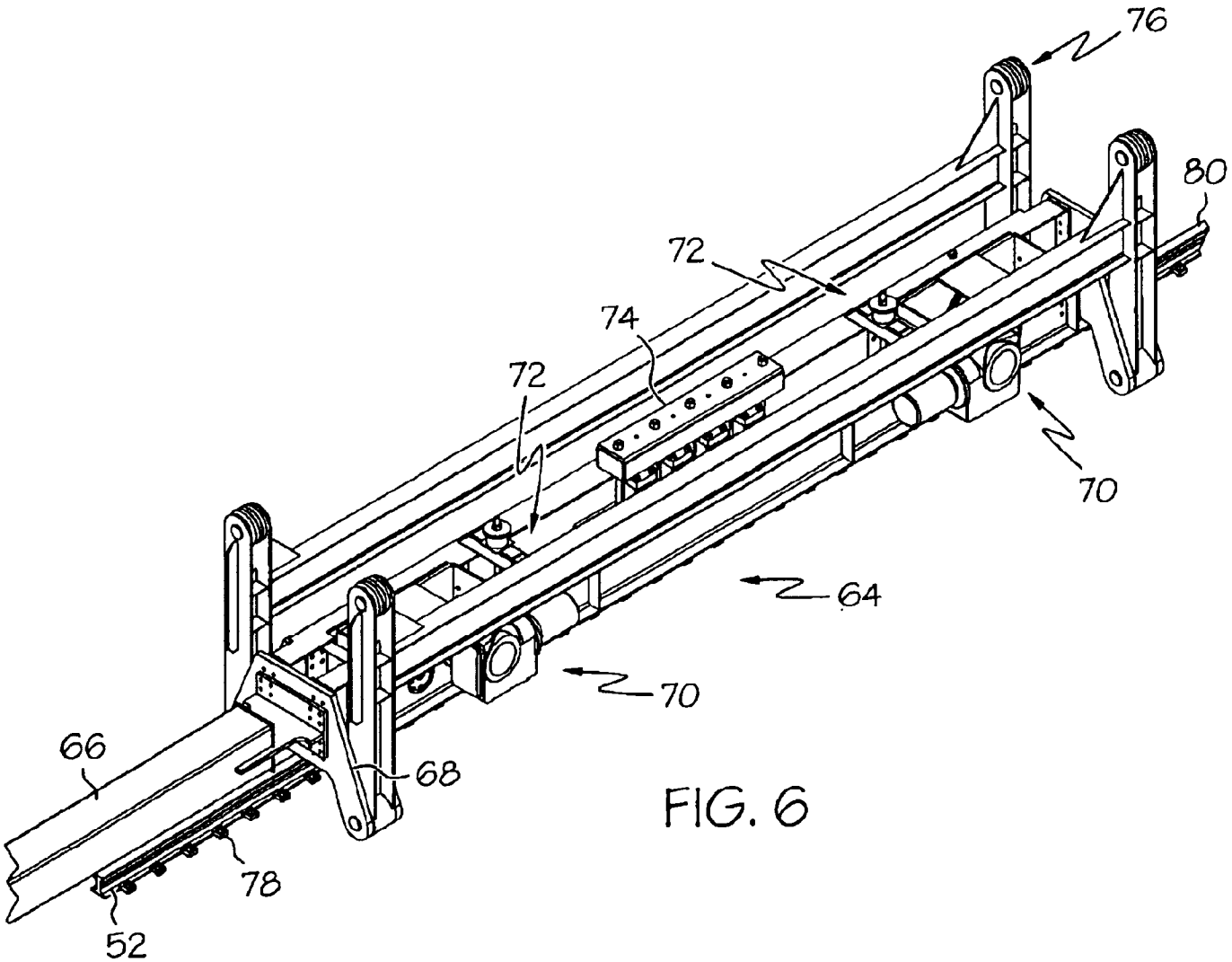
FIG. 6 is a fragmentary perspective view of a carrier assembly that is part of the roof portion of the stadium facility in the preferred embodiment.
Figure 10:
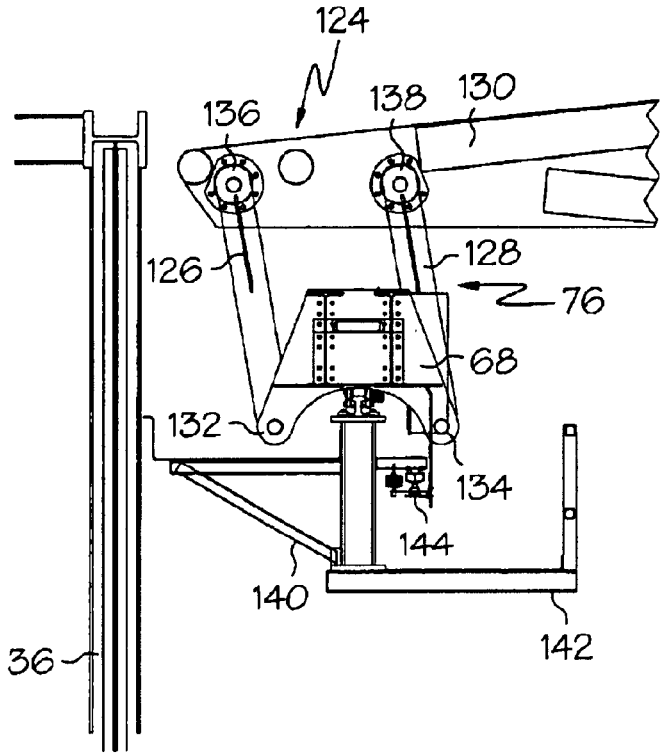
FIG. 10 is a fragmentary cross-sectional depiction of another area of the roof portion in the preferred embodiment of the invention.

A carrier assembly 64 is shown in greater detail in FIG. 6. Each carrier assembly 64 includes a frame 68, a wheelbox assembly 70, a retention assembly 72 and a brake assembly 74, all of which are supported by the frame 68. On the side of the roof panels that are supported by the first major truss 36, a parallel bar linkage system is provided between the carrier frame 68 and the supported end of the respective roof panel. The parallel bar linkage system, which is shown in greater detail in FIG. 10, is conceptually the same as that disclosed in U.S. patent application Ser. No. 09/609,728, the disclosure of which is hereby incorporated as if set forth fully herein, and its purpose is to compensate for movement of the two major trusses as a result of thermal expansion and deflection as a result of other forces such as wind.

Figure 7:
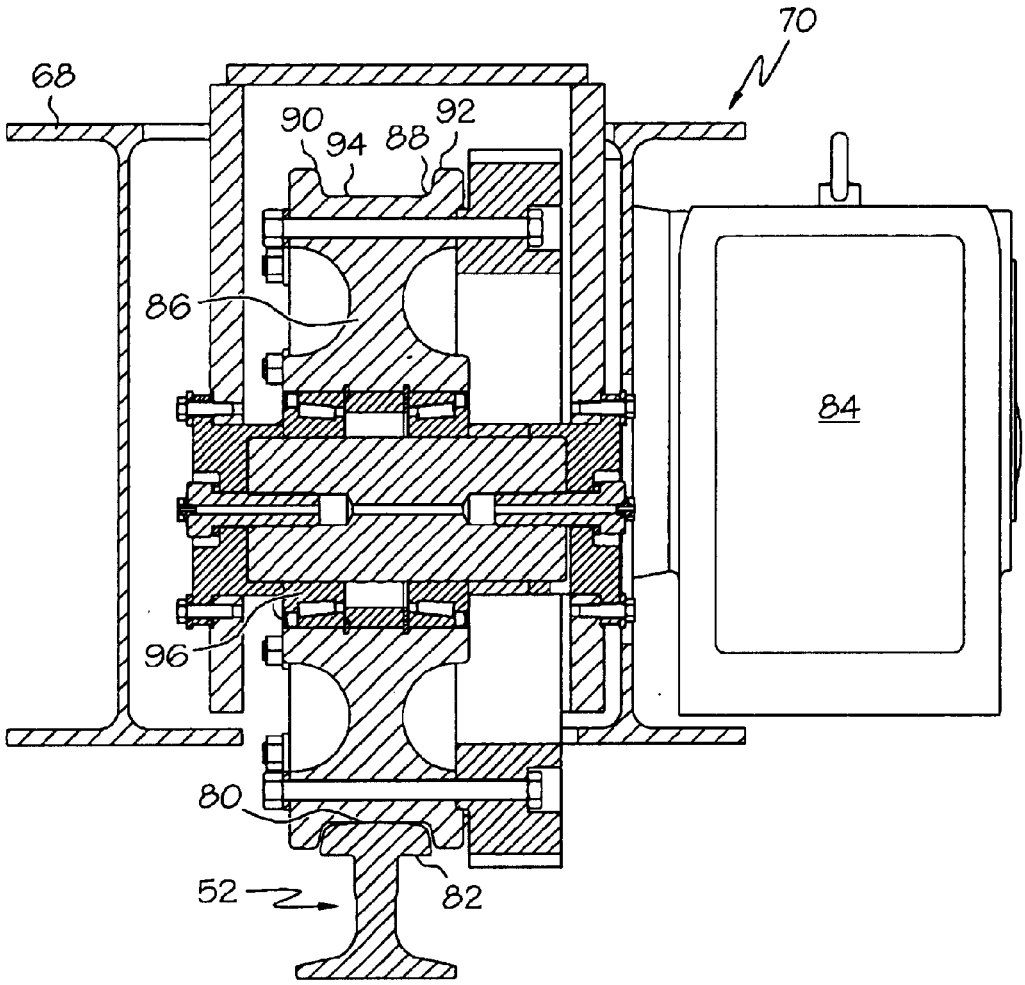
FIG. 7 is a cross-sectional view depicting a portion of the carrier assembly that is shown in FIG. 6.

FIG. 7 is a cross-sectional view illustrating a portion of the wheelbox assembly 70 that is provided on each of the carrier assemblies 64. Each of the rail members such as rail 52 is shaped so as to have a relatively flat upwardly facing surface 80 that is the main weight bearing surface of the rail 52. In addition, the rails are preferably machined so as to have a downwardly facing surface 82, which is defined as being a surface that has a downwardly facing component, including a downwardly facing horizontal surface or a sloped surface or surfaces that are sloped sufficiently downward in order to permit operation of the retention assembly 72 and the brake assembly 74 as will be described below. Wheelbox assembly 70 includes a motor/reduction gear assembly 84 that is configured to drive a wheel 86 having a profiled surface 88 that is adapted to rotatably engage the upwardly facing surface 80 of rail 52. Wheel 86 is supported for rotation relative to the frame 68 of the carrier assembly 64 by a roller bearing assembly 96. The profiled surface 88 includes a first flange 90 that prevents lateral displacement of the wheel 86 relative to the rail 52 in a first direction and a second flange 92 preventing lateral displacement in the second, opposite direction. A cylindrical rail engaging surface 94 positioned between the flanges 90, 92 is sized and shaped to ride on the upwardly facing surface 80 of the rail 52.

According to one important aspect of the invention, the motors in the motor/reduction gear assemblies 84 are preferably AC motors. In conventional stadium transport designs, DC motors have invariably been used. Unfortunately, it has been found that because of the large distances involved in such structures it is difficult to ensure that a plurality of DC motors will act in the necessary degree of synchronization. A string of DC motors controlled by variable speed drives do not easily synchronize. Since their speed is based on voltage rather than frequency, as AC motors, wiring conditions and terminations can induce small resistance variation between motors causing these to try to run at different speeds. This will result in the faster motor taking on a greater share of the load. In addition, as a result of the wind loads that typically account for a significant share of the motor capacity requirements in a stadium having a retractable roof, if the wind direction is diagonal to the roof, the motors on one side will be loaded heavier than the motors on the other side. In a DC design, this would result in a speed adjustment of the motors. Moreover, load differences that are induced by local roof and drive rail geometry can cause the local motors to slow down or speed up according to the load, forcing the control system to constantly hunt for the correct voltage level. This, in turn, can induce unwanted oscillation, which can damage the structure as well as the drive system. If the wind was gusting, the speed adjustment would have to be made continually.

It has therefore been found that AC motors will naturally strive to follow a given frequency, as long as the design load is not exceeding the capacity of the motor. Because of the natural synchronization provided between motors, the AC motor drive system of the present invention can appreciably increase the speed of opening and closing the roof structure.

Figure 8:
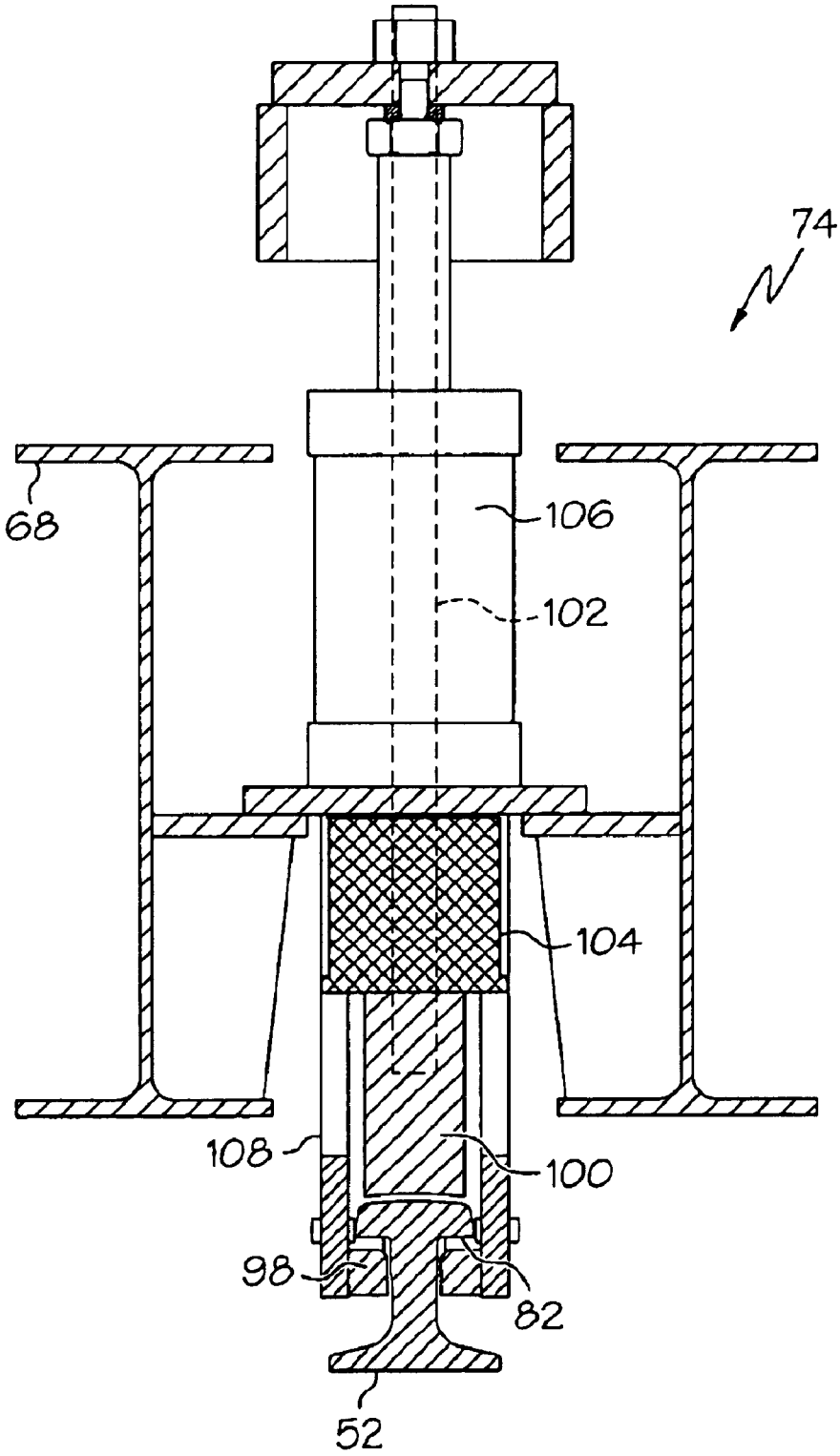
FIG. 8 is a cross-sectional view depicting another portion of the carrier assembly that is shown in FIG. 6.

The brake assembly 74, which is shown in cross-section in FIG. 8, includes a lower brake shoe 98 that is adapted to frictionally engage the downwardly facing surface 82 of the rail 52 when the brake assembly 74 is actuated. Brake assembly 74 further includes an upper brake shoe 100 for similarly frictionally engaging the upwardly facing surface 80 of the rail 52 when actuated. A pneumatic or hydraulic cylinder 106, a tie rod 102 and an elastomeric spring 104 are arranged so upon actuation of the pneumatic or hydraulic cylinder 106 the upper brake shoe 100 will be resiliently biased against the upwardly facing surface 80 of the rail 52 and, simultaneously, the lower brake shoe 98 will be pulled upwardly into engagement with the downwardly facing surface 82. This pitching motion when applied simultaneously for all of the carrier assemblies 64 transporting a particular roof panel will securely clamp the roof panel in position at a desired location. In addition, the presence of the lower brake shoes 98 enabled the brake assembly 74 to assist the retention assembly 72 in resisting upward forces as a result of wind or other factors that would tend to with the roof panel away from the rail 52 or, in a less severe situation, reduce the effective traction of the wheel 86 on the rail 52.

Figure 9:
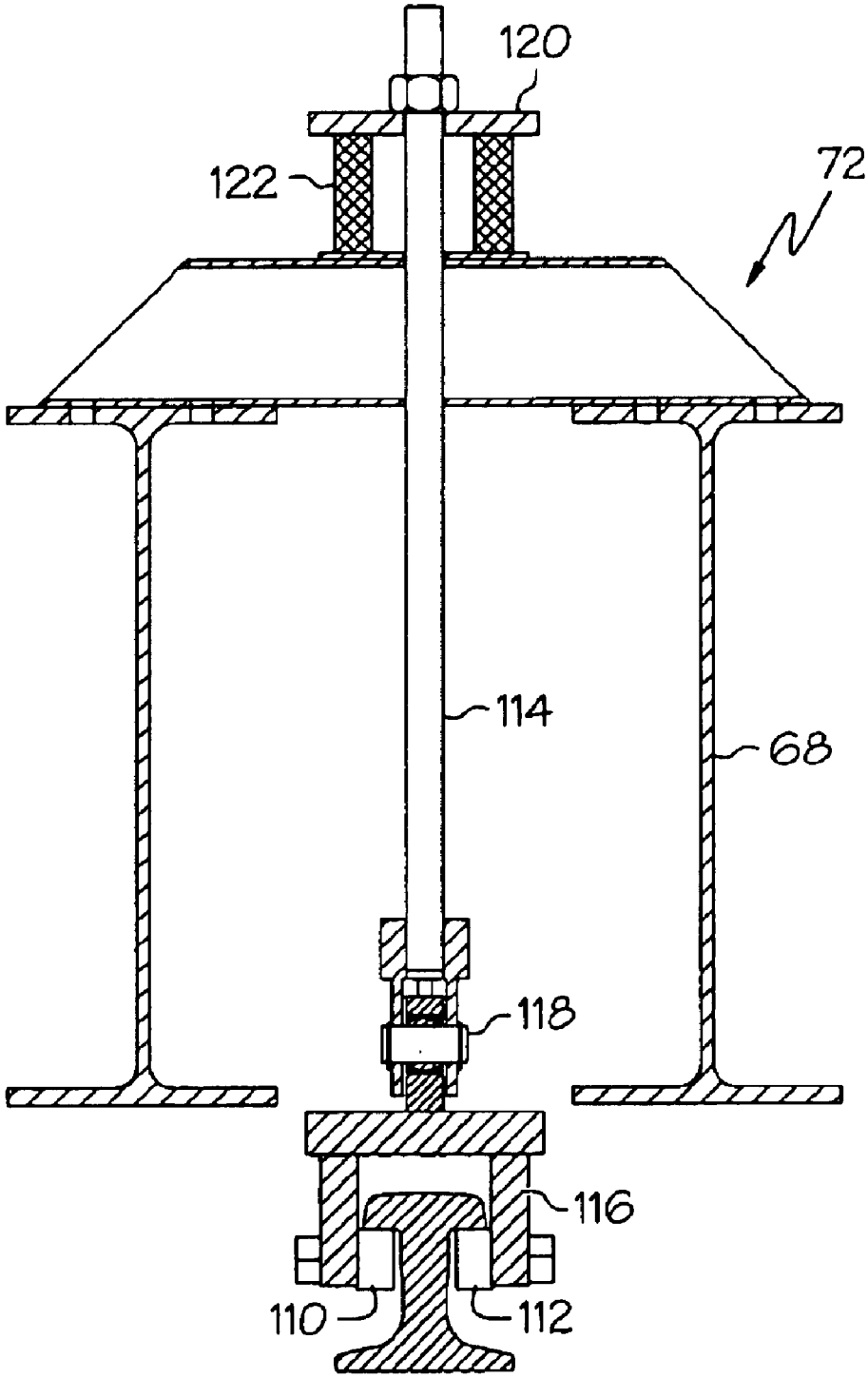
FIG. 9 is a cross-sectional view depicting a third portion of the carrier assembly that is shown in FIG. 6.

Referring now to FIG. 9, the purpose of the retention assembly 72 is to continuously bias each of the carrier assemblies 64 downwardly toward the supporting rail 52 so as to maintain sufficient traction of the drive wheel 86 on the rail 52 to ensure that the drive mechanism will be able to move movable roof panels as desired. This might otherwise be problematic, especially when wind forces would tend to lift the roof panel, especially when it is desired to move the roof panel along an upwardly inclined portion of the convex guide rail 52. As may be seen in FIG. 9, retention assembly 72 preferably includes a pair of wheels 110, 112 that are amounted for rotation with respect to a rail spanning member 116 so that each wheel is rotatably engaged with a portion of the downwardly facing surface 82 of the rail 52. A tie rod 114 is connected to the rail spanning member 116 by a spherical bearing 118, and an opposite end of the tie rod 114 is connected to a plate 120 that is upwardly biased with respect to the frame 68 of the carrier assembly 64 by means of a compressive spring, which in the preferred embodiment is fabricated from urethane.

FIG. 10 depicts the preferred embodiment of the roof mounting assembly 124 that is located on the side of the roof panels that are supported by the first major truss 36. As was discussed briefly above, the parallel bar linkage 76 includes a first structural link 126 and a second structural link 128 for connecting the frame 68 of the carrier assembly 64 to one end of a frame 130 of one of the roof panels. The first structural link 126 is pivotally mounted with respect to the frame 68 by a first pivot point 132, and the second structural link 128 is similarly pivotally mounted with respect to the frame 68 by a second pivot point 134. A second end of the first structural link 126 is pivotally mounted with respect to the roof panel frame 130 by a third pivot point 136, and the second end of the second structural link 128 is likewise pivotally mounted to the frame 130 by a pivot joint 138. FIG. 10 further shows a mounting bracket 140 that secures the frame 68 of the carrier assembly 64 to the first major truss 36. Mounting bracket 140 also supports a walkway 142, which extends along the length of the major truss 36 for maintenance and inspection purposes. An electric rail feed 144 is also supported by the mounting bracket 140, with appropriate electrical insulation, for supplying electricity to the drive system and as otherwise may be needed in the roof assembly 20.

Figure 11:
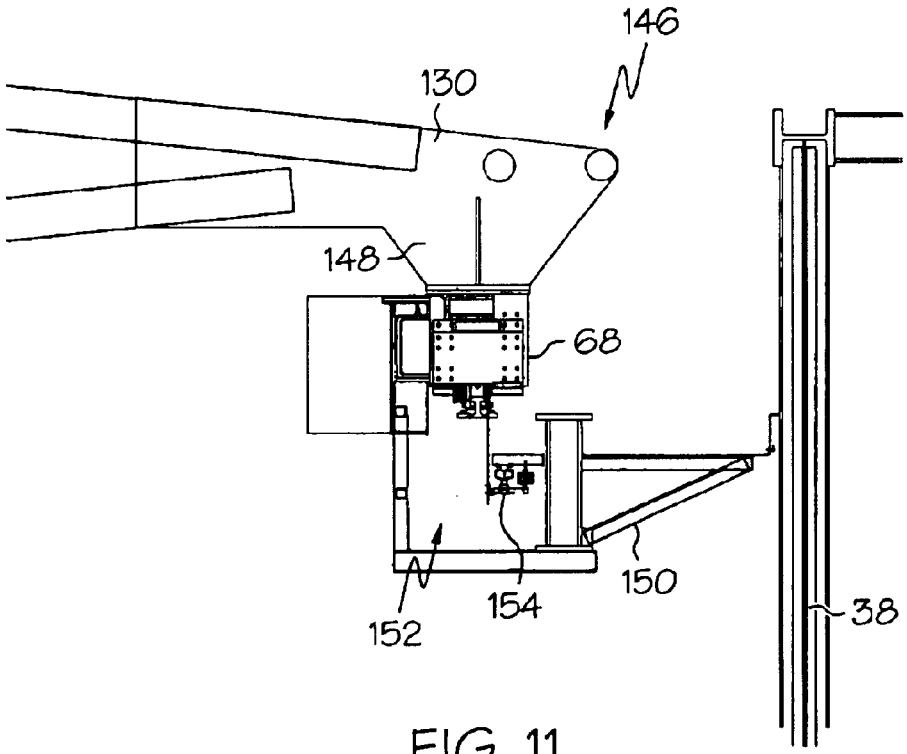
FIG. 11 is a fragmentary cross-sectional depiction of another area of the roof portion in the preferred embodiment of the invention.

FIG. 11 depicts the preferred embodiment of the roof mounting assembly 146 that is located on the side of the roof panels that are supported by the second major truss 38. This assembly 146 is identical to the first roof mounting assembly 124 shown in FIG. 10 with the exception that no parallel bar linkage is provided. Instead, a solid mounting assembly 148 is provided to secure the frame 68 of the carrier assembly 64 to the frame 130 of the roof panel.

Figure 12:
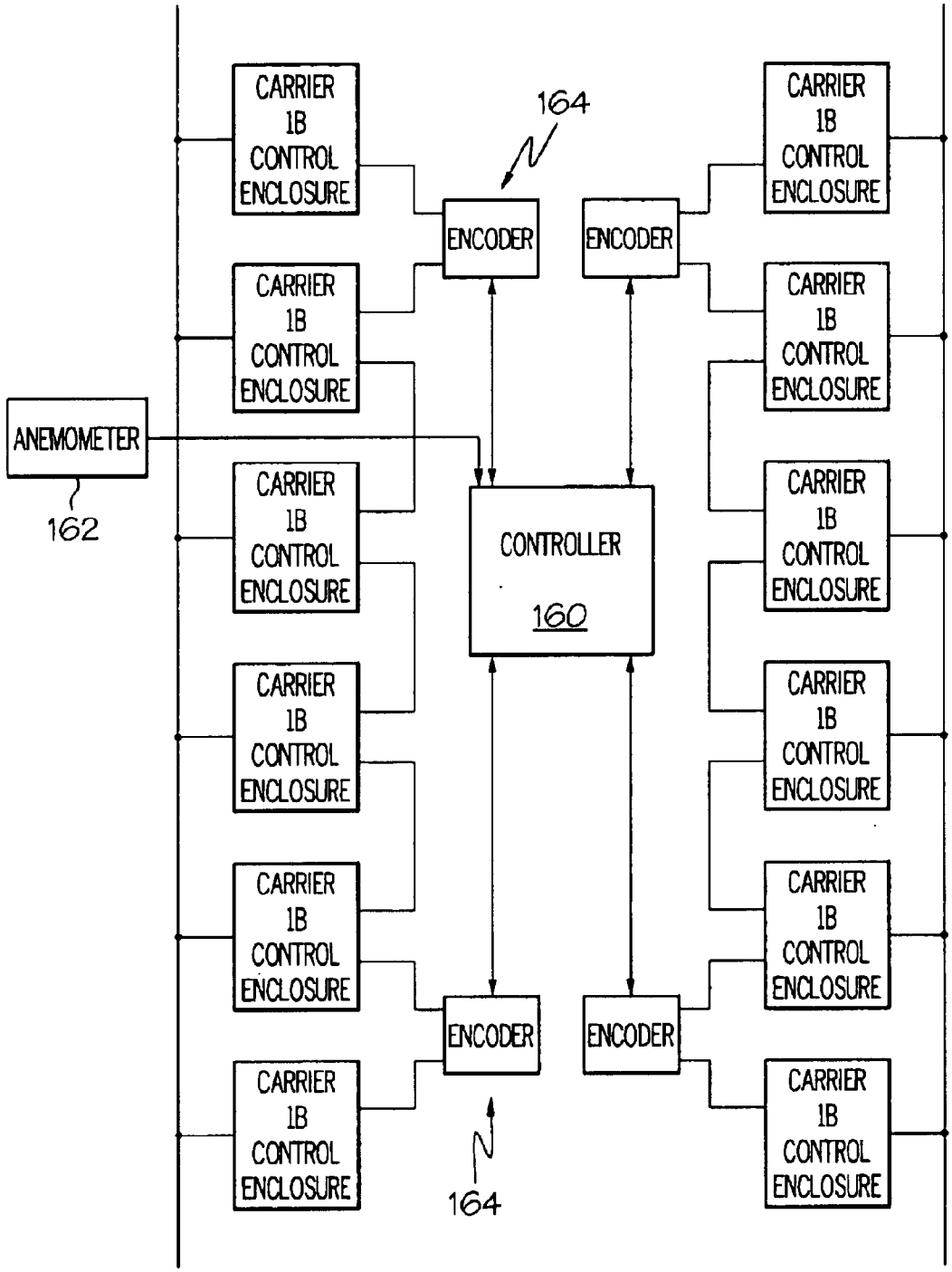
FIG. 12 is a schematic diagram depicting a control system for the convertible stadium facility according to the preferred embodiment of the invention.

Referring to FIG. 12, it will be seen that operation of the retractable roof assembly 20 and particularly the upper and lower movable roof panels 32, 34 is controlled by a controller 160, which is preferably a programmable logic controller (PLC). A plurality of position sensors 164 are provided to sense the position of each end of each of the movable roof panels 32, 34, and an anemometer 162 is also preferably provided to inform the controller 160 of wind-speed near the top of the stadium 14. In response to data that is provided by the anemometer 162, the controller 160 will set a maximum allowed speed for opening and closing the roof mechanism. The speed of the roof panels 32, 34 will preferably be controlled by a plurality of variable frequency drives (VFD's) 166, which control the frequency and voltage that is supplied to the electric motors 84.

One important function of the controller 160 is to maintain alignment of the movable roof panels 32, 34 during operation. In the preferred embodiment, the position sensors 164 are embodied as encoders that are located on each side of the roof panels 32, 34. In one embodiment, incremental encoders could be deployed. An incremental encoder sends a fixed number of pulses per revolution back to a count module, which keeps a running tally of the pulses. The quadrature encoder design used can recognize whether the shaft is turning in a forward or a reverse direction, and the counter can therefore count up or down, depending on the travel direction. In a second embodiment, an absolute encoder could be used which would not rely on a counter to be able to report its exact position. Preferably, error correction techniques are used to ensure that the controller 160 knows the precise location being reported. This can be done by anyone of a number of known logic techniques.

The acceleration and deceleration of the electric motors are an important aspect of the invention. The conventional method of operating equipment is referred to as "across the line starting," whereby a magnetic contactor energizes the electric motors and the motors begin outputting full torque within 1 or 2 seconds. Traditionally, when the mechanism begins to move a conventional 3-phase motor will output 3 times its nameplate horsepower and torque. On start-up, when natural initial forces resist the acceleration of the mechanism, the traction wheel assembly will frequently slip slightly on the track as it tries to accelerate the mechanism. This slipping action will cause excessive wear, significant building vibration and general abuse of the collateral machinery. The same is true on a conventional mechanism when stopping. When the power is removed a fail-safe spring set brake is normally energized, which brings the mechanism to a rapid stop causing the traction wheel to slip and significant vibrations, wear & tear, and other objectionable phenomena to occur.

Figure 13:
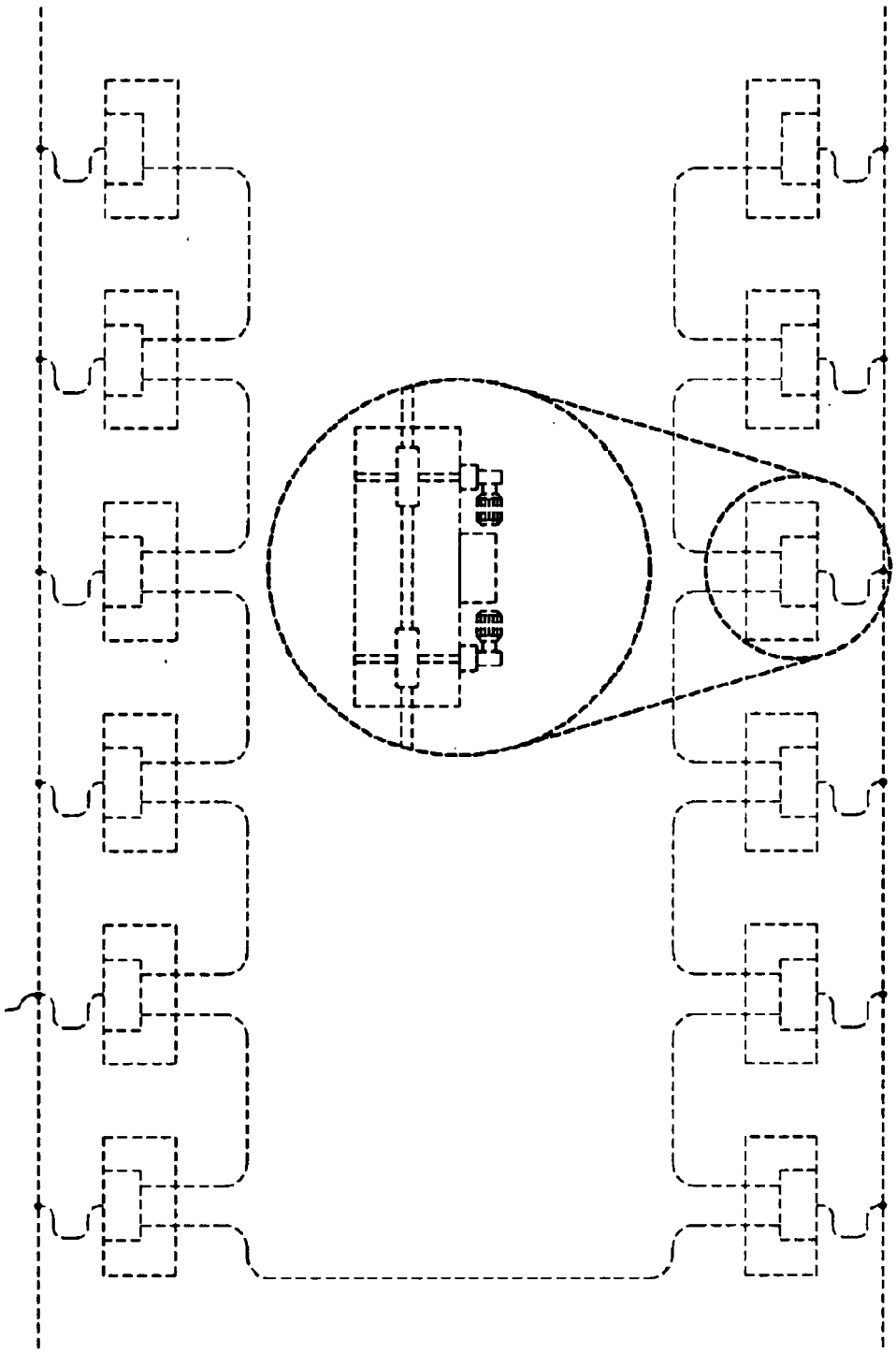
FIG. 13 is a schematic diagram depicting a drive system for the convertible stadium facility according to the preferred embodiment.
Figure 14:
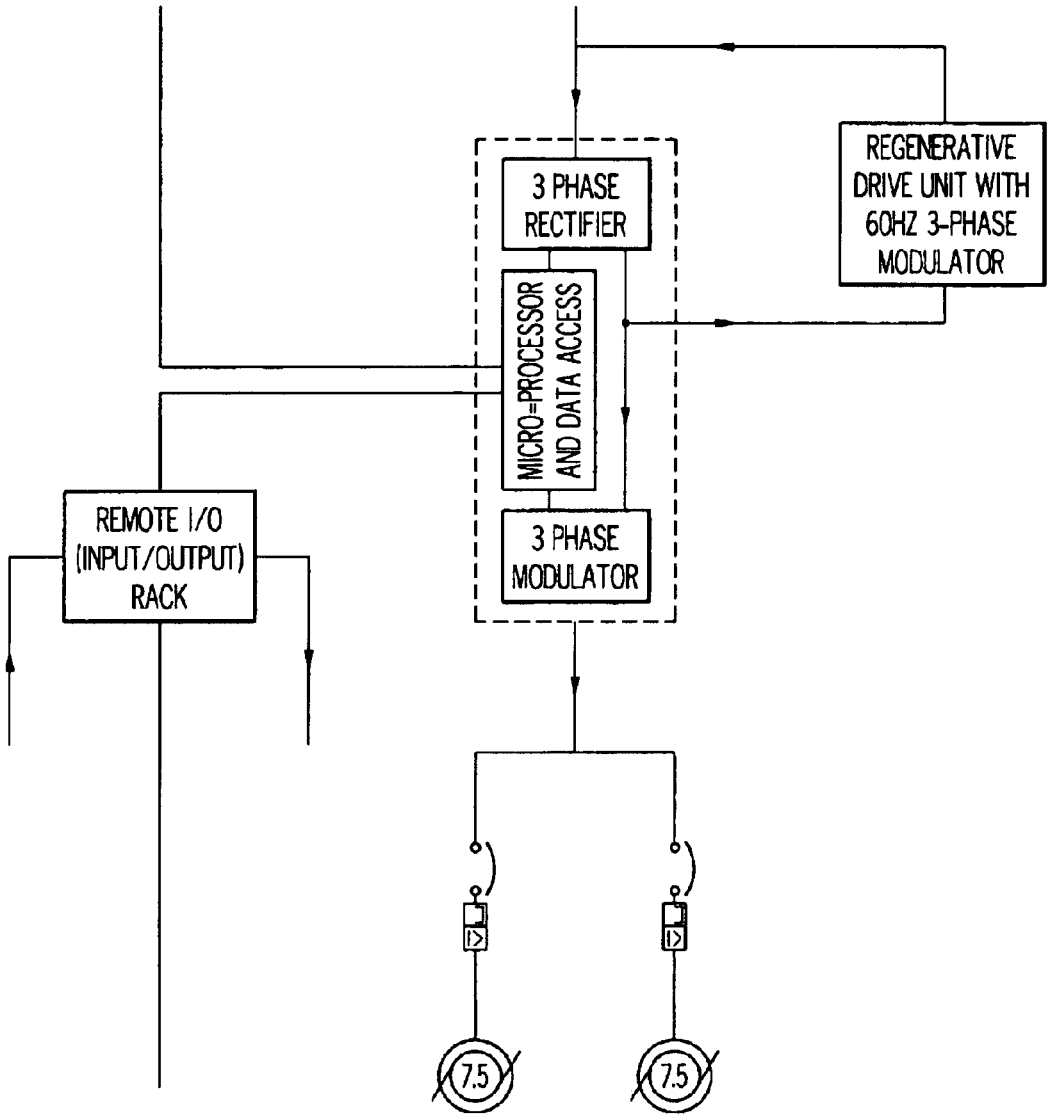
FIG. 14 is a schematic diagram depicting a motor control enclosure according to the preferred embodiment of the invention.

As shown in FIGS. 13 and 14, a system constructed according to the preferred embodiment includes a Variable Frequency Drive (VFD), which captures conventional AC current and converts it to DC current, then reconstructs the sign wave of the current back to a regulated AC sign form. This feature is very useful in the acceleration/deceleration phase. For example, on start-up the VFD will output current at approximately 5 to 10 Hertz rather than the conventional line current of 60 Hertz. Most all 3-phase AC motors are 4-pole motors. Preferably, conventional 3-phase 4-pole motors are utilized, primarily because they are extremely economical to purchase. A conventional 4-pole motor when powered with 60 Hertz current always turns at exactly 1750 RPM. The relationship of the 4-poles and the alternating current at 60 Hertz is fundamental, and the machine will always seek to run at 1750 RPM. With the application of the VFD the frequency can be reduced to as low as 5 Hertz, causing the motor to start at "creep" speed outputting a constant torque. At these low speeds it is required to inject a higher voltage to prevent rapid heat build-up, which is also a function of the micro-processor within the VFD. This micro-processor can be adjusted to output frequency on a sliding scale. Example: Over a period of 20 seconds the frequency will increase by 10 Hertz every 2 seconds. Thus, if the frequency begins at 10 Hertz, at the end of 10 seconds it will be at 100 Hertz causing the motor to run slightly faster than its normal RPM of 1750. This gives a gradual start, a gradual application of torque protecting the machinery, the building and all other mechanical equipment. The micro-processor is programmed based on predetermined calculations regarding the maximum torque and inertia that collateral equipment can withstand. It is a function of the stiffness of the building structure, the weight of the retractable roof, and the stiffness of the collateral machinery. The point is that the VFD is adjustable, and that by calculation the most favorable acceleration and/or deceleration curve may be determined.

The application of VFD's allows movement of the equipment to be commenced at a very slow speed, as well as to permit eventual acceleration of the equipment up to twice the normal speed of a standard 3-phase motor, thereby completing the cycle time at a much faster speed than a conventional arrangement. The VFD with the application of the Programmable Logic Controller (PLC) can also monitor the wind in and around the stadium. If it is found that the wind is of an excessive speed the VFD may be prevented from accelerating past a slower speed, thus protecting all of the machinery. This application of both the VFD and the PLC allows the mechanism to complete the opening cycle most of the time in half the speed of a conventional machine, while still maintaining the capability to slow down to ¼ the speed during high wind conditions to maintain safety. This arrangement is a significant improvement over conventional drives.

Another significant new feature that this arrangement provides applies to the curved track arrangement whereby the very heavy roof sections are on a sloping track. Thus, when the mechanized section must begin its operation it is very tricky to release the brakes and start the motor at exactly the same time, the danger being that the roof might back-up slightly before it begins going forward. This is similar to an automobile with a conventional clutch trying to start on a hill. The synchronization of these events is very difficult, however with the VFD electricity may be supplied through the VFD at just the right frequency and just the right voltage to lock the assembly in place when we automatically release the service brake, and then begin ramping up the frequency at just the right rate to make a very smooth and orderly start. This was impossible using conventional "across the line" starting. These features allow a curved track to operate safely.

Another feature provided by the PLC, coupled to the VFD, is the ability for the operator to continuously monitor the motor voltage, the motor frequency, and the motor output torque. These figures are displayed on the operator's information screen and recorded continuously for historic reference and troubleshooting. These diagnostic features allow the operator confidence that the mechanism is functioning as intended and offer an early warning as soon as an inconsistency develops in the mechanism long before a serious failure would occur. The historical data logging is programmed to download through the internet on a high-speed communications link to a remote facility, thus enabling engineers at that facility to monitor all systems in the field to be sure they are working properly. This offers a much higher level of safety than was achievable in the past. The combination of these devices allows an unsophisticated owner with no engineering staff to operate highly technical equipment that heretofore could not be operated without a staff of engineers on-site, thereby significantly reducing the cost of ownership.

It is to be understood, however, that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

What is claimed is:

1. A stadium roof assembly, comprising:

at least one major truss spanning a distance between a first support location and a second support location that is at least 200 feet, said major truss being structurally configured as a tied arch having a curved convex upper portion and a tensioned lower portion that extends directly beneath said curved convex upper portion and is shaped, sized and positioned to assume most gravity induced stress within the major truss as tension;

at least one roof member that is secured to said major truss;

a curved, convex guide track that is secured to said curved, convex upper portion of said major truss, and wherein said roof member is constructed and arranged to be moved over said guide track; and a retention mechanism for preventing said roof member from being lifted upwardly with respect to said guide track wherein said retention mechanism comprises at least one retention element for engaging a downwardly facing surface of said guide track in the event of initiation of upward vertical movement of said roof member relative to said guide track.

2. A roof assembly according to claim 1, comprising at least two of said major trusses.

3. A roof assembly according to claim 1, wherein said roof member is secured to said curved, convex upper portion of said major truss.

4. A roof assembly according to claim 1, wherein said roof member is mounted to said major truss so as to be movable with respect thereto.

5. A root assembly according to claim 1, wherein said major truss does not make substantial utilization of diagonal structural elements therein to assume horizontal stress within said major truss.

6. A roof assembly according to claim 1, wherein said roof member comprises a first wheel that is engaged with an upwardly facing surface of said guide track and wherein said retention element comprises a second wheel that is engaged with said downwardly facing surface of said guide track and further comprising a biasing mechanism for biasing the first wheel toward the second wheel, whereby both the first wheel and the second wheel will be urged against the guide track.

7. A roof assembly according to claim 6, further comprising a drive system for powering at least one of said first and second wheels.

8. A roof assembly according to claim 6, wherein said guide track is convex in shape, and wherein said biasing mechanism is adequate to bias said first and second wheels to ensure adequate traction with respect to said guide track so that said drive system will be able to move said roof member upwardly along the convex guide track against the forces of gravity.

9. A roof assembly according to claim 1, wherein said major truss is constructed and arranged to have a center of mass that is positioned substantially along a span axis that intersects both said first and second support locations.

10. A roof assembly according to claim 9, wherein said major truss is shaped so as to be substantially symmetrical about said span axis.

11. A roof assembly according to claim 1, wherein said major truss is generally lenticular in shape.

12. A roof assembly according to claim 11, wherein said major truss has a maximum vertical dimension $V_{max}$ and wherein said distance between said first support location and said second support location may be expressed as $L_{max}$, and wherein $V_{max}$ as a percentage of $L_{max}$ is within a range of about 4 percent to about 20 percent.

13. A roof assembly according to claim 12, wherein $V_{max}$ as a percentage of $L_{max}$ is within a range of about 5 percent to about 15 percent.

14. A roof assembly according to claim 13, wherein $V_{max}$ as a percentage of $L_{max}$ is within a range of about 10 percent to about 12.5 percent.

15. A roof assembly according to claim 12, wherein $L_{max}$ is at least 500 feet.

16. A convertible stadium assembly, comprising:

a stadium comprising an exhibition area, a seating area and a plurality of roof support locations;

a first major truss spanning a distance between a first of said roof support locations and a second of said roof support locations that is at least 200 feet, said first major truss being structurally configured as a tied arch having a curved convex upper portion and a tensioned lower portion that is shaped, sized and positioned to assume most gravity induced stress within the major truss as tension;

a second major truss spanning a distance between a third of said roof support locations and a fourth of said roof support locations that is also at least 200 feet, said second major truss also being structurally configured as a tied arch having a curved convex upper portion and a tensioned lower portion that is shaped, sized and positioned to assume most gravity induced stress within the major truss as tension;

a first guide track mounted to said first major truss, wherein said first guide track is substantially parallel to said second guide track;

a second guide track mounted to said second major truss, wherein said first and second guide tracks are both shaped so that upwardly facing surfaces thereof are both convex;

a movable roof member that is mounted for movement along said first guide track at a first location and that is further mounted for movement along said second guide track at a second a drive system for moving said movable roof member along said first and second guide tracks;

a control system for controlling said drive system; wherein said roof member comprises a first wheel that is engaged with an upwardly facing surface of said first guide track and a second wheel that is engaged with a downwardly facing surface of said first guide track, and further comprising a biasing mechanism for biasing the first wheel toward the second wheel, whereby both the first wheel and the second wheel will be urged against the guide track.

17. A convertible stadium according to claim 16, wherein said drive system is constructed and arranged for powering at least one of said first and second wheels.

18. A convertible stadium according to claim 16, wherein said drive system is constructed and arranged to apply power with sufficient traction to said first and second guide tracks so as to be able to move said movable roof member along said convex upwardly facing surfaces of said first and second guide tracks.

19. A convertible stadium assembly, comprising:

a stadium comprising an exhibition area, a seating area and a plurality of roof support locations;

a first support structure spanning a distance between a first of said roof support locations and a second of said roof support locations that is at least 200 feet;

a second support structure spanning a distance between a third of said roof support locations and a fourth of said roof support locations that is also at least 200 feet;

a first guide track mounted to said first support structure, said first guide track being shaped so as to be continuously convexly upwardly curved;

a second guide track mounted to said second support structure, said second guide track being shaped so as to be continuously convexly upwardly curved;

a movable roof member that is mounted for movement along said first guide track at a first location and that is further mounted for movement along said second guide track at a second location, wherein said roof member comprises a first wheel that is engaged with an upwardly facing surface of said first guide track and a second wheel that is engaged with a downwardly facing surface of said first guide track, and further comprising a biasing mechanism for biasing the first wheel toward the second wheel, whereby both the first wheel and the second wheel will be urged against the guide track;

a drive system for moving said movable roof member along said first and second guide tracks; and a control system for controlling said drive system.

20. A convertible stadium assembly according to claim 19, wherein said first guide track is substantially parallel to said second guide track.

21. A convertible stadium according to claim 19, wherein said drive system is constructed and arranged for powering at least one of said first and second wheels.

22. A convertible stadium according to claim 19, wherein said drive system is constructed and arranged to apply power with sufficient traction to said first and second guide tracks so as to be able to move said movable roof member along said convex upwardly facing surfaces of said first and second guide tracks.

23. A convertible stadium assembly, comprising:

a stadium comprising an exhibition area, a seating area and a plurality of roof support locations;

a first major truss spanning a distance between a first of said roof support locations and a second of said roof support locations that is at least 200 feet, said first major truss being structurally configured as a tied arch;

a second major truss spanning a distance between a third of said roof support locations and a fourth of said roof support locations that is also at least 200 feet, said second major truss also being structurally configured as a tied arch;

a first guide track mounted to said first major truss;

a second guide track mounted to said second major truss, wherein said first guide track is substantially parallel to said second guide track and said first and second guide tracks are both shaped so that upwardly facing surfaces thereof are both convex;

a movable roof member that is mounted for movement along said first guide track at a first location and that is further mounted for movement along said second guide track at a second location, wherein said roof member comprises a first wheel that is engaged with an upwardly facing surface of said first guide track and a second wheel that is engaged with a downwardly facing surface of said first guide track, and further comprising a biasing mechanism for biasing the first wheel toward the second wheel, whereby both the first wheel and the second wheel will be urged against the guide track;

a drive system for moving said movable roof member along said first and second guide tracks; and a control system for controlling said drive system.

* * * * *